US010287661B2

(12) United States Patent
Shibata et al.

(10) Patent No.: US 10,287,661 B2
(45) Date of Patent: May 14, 2019

(54) HOT-ROLLED STEEL SHEET AND METHOD FOR PRODUCING THE SAME

(71) Applicant: JFE STEEL CORPORATION, Tokyo (JP)

(72) Inventors: Tomoaki Shibata, Tokyo (JP); Sota Goto, Kawasaki (JP)

(73) Assignee: JFE STEEL CORPORATION, Tokyo (JP)

( * ) Notice: Subject to any disclaimer, the term of this patent is extended or adjusted under 35 U.S.C. 154(b) by 650 days.

(21) Appl. No.: 14/781,762

(22) PCT Filed: Mar. 20, 2014

(86) PCT No.: PCT/JP2014/001610
§ 371 (c)(1),
(2) Date: Oct. 1, 2015

(87) PCT Pub. No.: WO2014/162680
PCT Pub. Date: Oct. 9, 2014

(65) Prior Publication Data

US 2016/0017466 A1 Jan. 21, 2016

(30) Foreign Application Priority Data

Apr. 4, 2013 (JP) ..... 2013-078395

(51) Int. Cl.
*C21D 8/02* (2006.01)
*C22C 38/38* (2006.01)
(Continued)

(52) U.S. Cl.
CPC ..... *C22C 38/38* (2013.01); *C21D 6/001* (2013.01); *C21D 6/002* (2013.01); *C21D 6/005* (2013.01);
(Continued)

(58) Field of Classification Search
CPC ..... C21D 2211/002; C21D 2211/005; C21D 2211/008; C21D 6/001; C21D 6/002;
(Continued)

(56) References Cited

U.S. PATENT DOCUMENTS 7,501,030 B2 3/2009 Nakata
8,926,766 B2 1/2015 Shimamura
(Continued)

FOREIGN PATENT DOCUMENTS

CN 1628183 6/2005
CN 101641456 2/2010
(Continued)

OTHER PUBLICATIONS

Extended European Search Report dated May 4, 2016 for European Application No. 14778532.3, 9 pages.
(Continued)

*Primary Examiner* — Matthew E. Hoban
*Assistant Examiner* — Anthony M Liang
(74) *Attorney, Agent, or Firm* — Ratnerprestia

(57) ABSTRACT

A hot-rolled steel sheet is provided having high strength and excellent toughness and ductility includes a composition that contains, on a mass percent basis, 0.04% or more and 0.15% or less of C, 0.01% or more and 0.55% or less of Si, 1.0% or more and 3.0% or less of Mn, 0.03% or less P, 0.01% or less S, 0.003% or more and 0.1% or less of Al, 0.006% or less N, 0.035% or more and 0.1% or less Nb, 0.001% or more and 0.1% or less of V, 0.001% or more and 0.1% or less Ti, and the balance being Fe and incidental impurities, in which the hot-rolled steel sheet includes a microstructure in which the proportion of precipitated Nb to the total amount of Nb is 35% or more and 80% or less, the volume fraction of tempered martensite and/or tempered bainite having a lath interval of 0.2 μm or more and 1.6 μm or less is 95% or more
(Continued)

at a position 1.0 mm from a surface of the sheet in the thickness direction, and the volume fraction of ferrite having a lath interval of 0.2 μm or more and 1.6 μm or less at the center position of the sheet in the thickness direction is 95% or more.

8 Claims, 2 Drawing Sheets

(51) Int. Cl.

| | |
|---|---|
| ***C22C 38/00*** | (2006.01) |
| ***C22C 38/14*** | (2006.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/16*** | (2006.01) |
| ***C22C 38/18*** | (2006.01) |
| ***C22C 38/24*** | (2006.01) |
| ***C22C 38/26*** | (2006.01) |
| ***C22C 38/28*** | (2006.01) |
| ***C21D 6/00*** | (2006.01) |

(52) U.S. Cl.
CPC ..... *C21D 6/008* (2013.01); *C21D 8/0263* (2013.01); *C21D 9/46* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/24* (2013.01); *C22C 38/26* (2013.01); *C22C 38/28* (2013.01); *C21D 8/021* (2013.01); *C21D 8/0226* (2013.01); *C21D 2211/002* (2013.01); *C21D 2211/008* (2013.01)

(58) Field of Classification Search
CPC ..... C21D 6/005; C21D 6/008; C21D 8/021; C21D 8/0226; C21D 8/0263; C21D 9/46; C22C 3/00; C22C 3/001; C22C 3/002; C22C 3/02; C22C 3/04; C22C 3/06; C22C 3/08; C22C 3/12; C22C 3/14; C22C 3/15; C22C 3/18; C22C 3/24; C22C 3/26; C22C 3/28; C22C 3/38
See application file for complete search history.

(56) References Cited

U.S. PATENT DOCUMENTS

| | | | |
|---|---|---|---|
| 2010/0263773 | A1 | 10/2010 | Cho |
| 2011/0126944 | A1 | 6/2011 | Kami |
| 2011/0284137 | A1 | 11/2011 | Kami |

FOREIGN PATENT DOCUMENTS

| | | | |
|---|---|---|---|
| CN | 101821419 | | 9/2010 |
| CN | 101932744 | | 12/2010 |
| EP | 1462535 | | 9/2004 |
| EP | 1473376 | | 11/2004 |
| EP | 2128295 | | 12/2009 |
| EP | 2202327 | | 6/2010 |
| EP | 2258886 | | 12/2010 |
| EP | 2309014 | | 4/2011 |
| EP | 2392681 | | 12/2011 |
| EP | 2392682 | | 12/2011 |
| EP | 2728029 | | 5/2014 |
| JP | 2004315957 | | 11/2004 |
| JP | 2006265577 | | 10/2006 |
| JP | 2010196157 | | 9/2010 |
| JP | 2010196161 | | 9/2010 |
| JP | 2010196163 | | 9/2010 |
| JP | 2010196164 | | 9/2010 |
| JP | 2011017061 | | 1/2011 |
| JP | 2011094230 | | 5/2011 |
| JP | 2012153963 | A | 8/2012 |
| JP | 2012255176 | | 12/2012 |
| JP | 2013007080 | | 1/2013 |
| JP | 2014009376 | | 1/2014 |
| JP | 2014009377 | | 1/2014 |
| KR | 20110025871 | | 3/2011 |
| KR | 1020110102483 | | 9/2011 |
| WO | 2013002413 | | 1/2013 |

OTHER PUBLICATIONS

Korean Office Action with partial translation for 1020157027240, dated Aug. 29, 2016, 8 pages.
International Search Report for International Application No. PCT/JP2014/001610 dated Jul. 1, 2014.
Korean Notice of Allowance for Korean Application No. 10-2015-7027240, with English translation, dated Feb. 16, 2017, 2 pages.
CN Office Action/Search Report, with parial English translation, for Application No. 201480019788.9, dated May 18, 2016, 13 pages.

HOT-ROLLED STEEL SHEET AND METHOD FOR PRODUCING THE SAME

CROSS-REFERENCE TO RELATED APPLICATIONS

This is the U.S. National Phase application of PCT International Application No. PCT/JP2014/001610, filed Mar. 20, 2014, and claims priority to Japanese Patent Application No. 2013-078395, filed Apr. 4, 2013, the disclosures of each of these applications being incorporated herein by reference in their entireties for all purposes.

FIELD OF THE INVENTION

Aspects of the present invention relate to hot-rolled steel sheets suitable as a steel material for steel pipes, for example, X80-grade steel pipes specified by American Petroleum Institute (API), used for pipe lines, oil country tubular goods, civil engineering and construction, and so forth, the hot-rolled steel sheet having high strength and excellent low-temperature toughness and ductility, and a method for producing the hot-rolled steel sheet.

BACKGROUND OF THE INVENTION

In recent years, in order to improve the transportation efficiency of natural gas and oil, high-strength large-diameter heavy wall steel pipes that can withstand the high-pressure operation have been used for line pipes because of an increase in demand for energy. To meet the demand, hitherto, UOE steel pipes made of plates have been mainly used. Recently, however, a strong demand for a further reduction in the cost of pipeline construction, the undersupply of UOE steel pipes, and so forth have strongly required a reduction in the steel material cost of steel pipes. Thus, electric resistance welded steel pipes or tubes and spiral steel pipes, which are produced in higher productivity and less expensive than those of UOE steel pipes and which are made of hot-rolled steel sheets, have been used.

Here, pipelines are often constructed in cold weather regions with, for example, abundant natural gas reserves. Thus, steel sheets used as steel materials for line pipes are required to have high strength and excellent low-temperature toughness. Hitherto, electric resistance welded steel pipes or tubes and spiral steel pipes have been widely used for automotive members, steel pipe piles, and so forth and are typically made of hot-rolled steel sheets with a relatively small thickness. However, in the case where heavy wall steel pipes are required, it is necessary to use hot-rolled steel sheets with a larger thickness than ever before. In the case where steel sheets with a large thickness are produced, in particular, surface regions of steel sheets in the thickness direction are processed under severe conditions. Furthermore, line pipes constructed over long distances may be forcefully deformed by crustal change, such as an earthquake. Thus, hot-rolled steel sheets used as materials for line pipes are required to have elongation characteristics that can withstand the foregoing processing and deformation in terms of the overall thickness, in addition to desired strength and low-temperature toughness.

In light of the foregoing circumstances, nowadays, various techniques regarding hot-rolled steel materials for line pipes are reported.

For example, Patent Literature 1 reports a technique for providing a hot-rolled steel strip for a high-strength electric resistance welded steel pipe, the hot-rolled steel strip having excellent low-temperature toughness and weldability and having a composition which contains, on a mass % basis, 0.005% to 0.04% C, 0.05% to 0.3% Si, 0.5% to 2.0% Mn, 0.001% to 0.1% Al, 0.001% to 0.1% Nb, 0.001% to 0.1% V, 0.001% to 0.1% Ti, 0.03% or less P, 0.005% or less S, 0.006% or less N, one or more of 0.5% or less Cu, 0.5% or less Ni, and 0.5% or less Mo, and the balance being Fe and incidental impurities and in which when Pcm=[% C]+[% Si]/30+([% Mn]+[% Cu])/20+[% Ni]/60+[% Mo]/7+[% V]/10, Pcm is 0.17 or less, the hot-rolled steel strip having a microstructure that contains bainitic ferrite serving as a main phase, the bainitic ferrite accounting for 95% by volume or more in the whole microstructure.

Patent Literature 2 reports a technique for providing a heavy high-strength hot-rolled steel sheet having excellent low-temperature toughness and uniformity of a steel material in the thickness direction and having a composition which contains, on a mass % basis, 0.02% to 0.08% C, 0.01% to 0.50% Si, 0.5% to 1.8% Mn, 0.025% or less P, 0.005% or less S, 0.005% to 0.10% Al, 0.01% to 0.10% Nb, 0.001% to 0.05% Ti, and the balance being Fe and incidental impurities, C, Ti, and Nb being contained in such a manner that ([% Ti]+([% Nb]/2))/[% C]<4, the hot-rolled steel sheet having a microstructure in which the difference ΔD between the average grain size of a ferrite phase serving as a main phase at a position 1 mm from a surface of the steel sheet in the thickness direction and the average grain size of the ferrite phase serving as the main phase at the center position of the steel sheet in the thickness direction of the ferrite phase serving as the main phase at the center position of the steel sheet in the thickness direction is 2 μm or less, in which the difference ΔV between the fraction (percent by volume) of a second phase at the position 1 mm from the surface of the steel sheet in the thickness direction and the fraction (percent by volume) of the second phase at the center position of the steel sheet in the thickness direction is 2% or less, and in which the minimum lath interval a bainite phase or a tempered martensite phase at the position 1 mm from the surface of the steel sheet in the thickness direction is 0.1 μm or more.

Patent Literature 3 reports a technique for providing a hot-rolled steel sheet having a tensile strength TS of 760 MPa or more in terms of strength and a fracture transition temperature vTrs of −100° C. or lower in terms of toughness, the hot-rolled steel sheet having a composition that contains, on a mass %, 0.03% to 0.06% C, 1.0% or less Si, 1% to 2% Mn, 0.1% or less Al, 0.05% to 0.08% Nb, V: 0.05% to 0.15% V, 0.10% to 0.30% Mo, and the balance being Fe and incidental impurities, and the hot-rolled steel sheet having a microstructure which is composed of a bainite single phase and in which carbonitrides of Nb and V are dispersed in the bainite phase in an amount of 0.06% or more in terms of the total amount of Nb and V.

Regarding techniques relating to heavy steel plates unlike hot-rolled steel sheets, Patent Literature 4 reports a technique for providing a high-strength steel sheet having low yield ratio and excellent uniform elongation characteristics, the steel sheet having a composition that contains, on a mass % basis, 0.06% to 0.12% C, 0.01% to 1.0% Si, 1.2% to 3.0% Mn, 0.015% or less P, 0.005% or less S, 0.08% or less Al, 0.005% to 0.07% Nb, 0.005% to 0.025% Ti, 0.010% or less N, 0.005% or less O, and the balance being Fe and incidental impurities, the steel sheet having a two-phase microstructure including bainite and an M-A constituent, and the M-A constituent having an area ratio of 3% to 20% and a circle equivalent diameter of 3.0 μm or less.

Patent Literature 5 reports a technique: a method for producing a heavy high-strength hot rolled steel sheet with excellent strength-ductility balance, the method including heating a steel and subjecting the steel to hot rolling including rough rolling and finishing rolling, the steel containing, on a mass % basis, 0.02% to 0.08% C, 0.01% to 0.50% Si, 0.5% to 1.8% Mn, 0.025% or less P, 0.005% or less S, 0.005% to 0.10% Al, 0.01% to 0.10% Nb, 0.001% to 0.05% Ti, and the balance being Fe and incidental impurities, C, Ti, and Nb being contained in such a manner that ([% Ti]+([% Nb]/2))/[% C]<4; performing accelerated cooling including primary accelerated cooling and secondary accelerated cooling, the primary accelerated cooling being performed in such a manner that a temperature at a position 1 mm from a surface of a sheet in the thickness direction is lowered to a primary cooling stop temperature of 650° C. or lower and 500° C. or higher at an average cooling rate of 10° C./sec. or more at a center position of the sheet in the thickness direction and in such a manner that a difference in cooling rate between the average cooling rate at the center position of the sheet in the thickness direction and an average cooling rate at the position 1 mm from the surface of the sheet in the thickness direction is less than 80° C./sec, and the secondary accelerated cooling being performed in such a manner that a temperature at the center position of the sheet is lowered to a secondary cooling stop temperature equal to or lower than BFS (° C.)=770-300C-70Mn-70Cr-170Mo-40Cu-40Ni-1.5CR (CR: cooling rate (° C./sec.)) at an average cooling rate of 10° C./sec. or more at the center position of the sheet in the thickness direction and in such a manner that a difference in cooling rate between the average cooling rate at the center position of the sheet in the thickness direction and the average cooling rate at the position 1 mm from the surface of the sheet in the thickness direction is 80° C./sec. or more; and after the second accelerated cooling, performing coiling at a coiling temperature equal to or lower than BFS0 (° C.)=770-300C-70Mn-70Cr-170Mo-40Cu-40Ni at the center position of the sheet in the thickness direction.

PATENT LITERATURE

[PTL 1] Japanese Unexamined Patent Application Publication No. 2004-315957

[PTL 2] Japanese Unexamined Patent Application Publication No. 2010-196157

[PTL 3] Japanese Unexamined Patent Application Publication No. 2011-17061

[PTL 4] Japanese Unexamined Patent Application Publication No. 2011-94230

[PTL 5] Japanese Unexamined Patent Application Publication No. 2010-196163

SUMMARY OF THE INVENTION

However, in any related art described above, it is significantly difficult to provide a heavy hot-rolled steel sheet which is suitable as a steel material for line pipes, in other words, which has high strength, excellent low-temperature toughness, and sufficient ductility that can withstand severe processing conditions during pipe production and forced deformation due to crustal change after construction.

In the technique reported in Patent Literature 1, as described in examples, the cooling rate after the completion of the hot rolling is controlled to 20° C./s or less to provide a desired microstructure of the hot-rolled steel strip (microstructure in which bainitic ferrite serving as the main phase accounts for 95% by volume or more). Thus, there are problems in which the lath in bainitic ferrite is liable to increase to readily reduce strength (in particular, tensile strength). Furthermore, in the technique reported in Patent Literature 1, it is essential that one or more of Cu, Ni, and Mo be added in order to ensure hardenability. However, these elements are scarce elements and may be obstructive to stable production in the future; hence, these elements are not preferred as essential elements.

In the technique reported in Patent Literature 2, in order to form a desired microstructure of the hot-rolled steel sheet, it is necessary to perform cooling at an average cooling rate of 100° C./sec. or more at a position 1 mm from the surface of the steel sheet in the thickness direction and an average cooling rate of 10° C./sec. or more at the center position of the sheet in the thickness direction after the completion of hot rolling. In such a technique in which the cooling rate near the sheet surface is increased, in particular, a larger sheet thickness results in an excessively higher cooling rate at the sheet surfaces to lead to the excessively high hardness of surface layers, disadvantageously reducing elongation in terms of the overall thickness.

Regarding steel materials for line pipes, elongation characteristics in terms of the overall thickness are important in addition to strength and low-temperature toughness as described above. In the case of a heavy hot-rolled steel sheet, however, when an attempt is made to achieve a predetermined cooling rate at the center position of the sheet in the thickness direction after the completion of hot rolling, the cooling rate is extremely increased in the surface layer regions of the sheet in the thickness direction. This results in markedly high hardness in the surface layer regions of the sheet in the thickness direction to reduce the elongation characteristics in terms of the overall thickness. In particular, with the recent progress of higher strength, the problem of the reduction in elongation characteristics in terms of the overall thickness has become manifest. Such a reduction in elongation characteristics in terms of the overall thickness causes pipe production to be extremely difficult. Furthermore, in the case where line pipes are formed of the steel sheets, a serious accident may be caused when forced deformation due to earthquake or the like occurs.

In the technique reported in Patent Literature 3, in order to form a desired microstructure of the hot-rolled steel sheet, it is also necessary to perform cooling to a temperature range of 550° C. to 650° C. at an average cooling rate of 20° C./sec. or more at the center position of a sheet in the thickness direction after the completion of hot rolling. In particular, the technique reported in Patent Literature 3 is a technique relating to a very-high-strength hot-rolled steel sheet with a tensile strength TS of 760 MPa or more. Thus, in the case where the sheet has an increased thickness, in particular, surface layer regions of the sheet have increased hardness. This causes a problem in which the elongation characteristics in terms of the overall thickness are liable to deteriorate.

To address the foregoing problems, in the technique reported in Patent Literature 4, the uniform elongation characteristics are ensured by the formation of the microstructure in which the M-A constituent is dispersed uniformly and finely in the bainite phase. However, in the technique reported in Patent Literature 4, it is essential that the M-A constituent be contained in an amount of 3% or more. Thus, there is a problem in which the toughness (in particular, (drop weight tear test (DWTT) properties) is liable to degrade. To provide the foregoing microstructure, after hot rolling, cooling is performed in such a manner that the average temperature of the steel sheet is reduced to 500°

C. to 680° C., and immediately thereafter, reheating is performed to 550° C. to a cooling start temperature. However, in order to increase the average temperature of the steel sheet, there are problems in which reheating equipment or the like is practically required to be arranged and the production process is complicated.

In the technique reported in Patent Literature 5, the difference in cooling rate between the average cooling rate at the center position of the sheet in the thickness direction and the average cooling rate at the position 1 mm from the surface of the sheet in the thickness direction is less than 80° C./sec. in the cooling step after the completion of the hot rolling, thereby ensuring the strength-ductility balance of the heavy high-strength hot rolled steel sheet. However, in a heavy plate with a thickness of 1 inch (25.4 mm) or more, which is high in demand as steel materials for line pipes, oil country tubular goods, and civil engineering and construction, in order to perform cooling to a predetermined temperature while the difference in cooling rate between the average cooling rate at the center position of the sheet in the thickness direction and the average cooling rate at the position 1 mm from the surface of the sheet in the thickness direction is controlled to less than 80° C./sec, it is necessary to prolong the cooling time by, for example, the arrangement of many cooling banks or a reduction in the transportation velocity of the steel sheet, thereby disadvantageously reducing the production efficiency and causing the arrangement of additional equipment to be required.

The present invention solves the foregoing problems of the related art and aims to provide a hot-rolled steel sheet having excellent strength, toughness, and elongation characteristics in terms of the overall thickness, the hot-rolled steel sheet being suitable as a steel material for X80-grade electric resistance welded steel pipes or X80-grade spiral steel pipes, and a method for producing the hot-rolled steel sheet.

Regarding a heavy hot-rolled steel sheet having a thickness of, for example, 12 mm or more, the inventors have conducted intensive studies of means for improving the elongation characteristics in terms of the overall thickness while high strength and high toughness are ensured with the addition of scarce elements, such as Cu, Ni, and Mo, minimized.

The inventors have focused their attention on ferrite, tempered martensite, and tempered bainite, which have excellent toughness and ductility, and have conducted studies of means for ensuring the strength of a hot-rolled steel sheet having these microstructures as main phases without the addition of a strengthening element, for example, Cu, Ni, or Mo.

The inventors have found that a ferrite having a lath structure exists and the ferrite having the lath structure exhibits transformation strengthening, depending on a lath interval serving as an efficacious controlling factor.

The lath structure of the ferrite cannot be observed with an optical microscope and can be identified by structure observation (magnification: ×5000 to ×20000) with a transmission electron microscope (TEM) or a scanning electron microscope (SEM). The lath structure is observed in, for example, acicular ferrite and bainitic ferrite, and is not observed in polygonal ferrite.

In the case of a hot-rolled steel sheet containing the ferrite having the lath structure, tempered martensite, and tempered bainite serving as main phases, a smaller lath interval of the lath structure results in a higher strength of the hot-rolled steel sheet. In contrast, an extremely small lath interval results in reductions in the low-temperature toughness and elongation characteristics of the hot-rolled steel sheet. It is thus difficult to strengthen the hot-rolled steel sheet only by the reductions in the lath intervals of the ferrite having the lath structure, tempered martensite, and tempered bainite while high toughness and excellent elongation characteristics are maintained.

For this reason, the inventors have conducted studies of means for ensuring the desired strength of the hot-rolled steel sheet without extremely reducing the lath intervals of the ferrite having the lath structure, tempered martensite, and tempered bainite and have found that precipitation strengthening is used in addition to the foregoing transformation strengthening and that ensuring both the precipitation strengthening and transformation strengthening is used as highly effective means. The inventors have conducted further studies and have found that the main controlling factor of the precipitation strengthening is the precipitation of Nb and that the adjustment of the lath intervals of the ferrite having the lath structure, tempered martensite, and tempered bainite and the proportion of precipitated Nb provides a high-strength hot-rolled steel sheet having desired strength and excellent low-temperature toughness and ductility.

Moreover, the inventors have found that regarding the production of a hot-rolled steel sheet by hot-rolling a continuous cast slab having a predetermined composition, the hot-rolled steel sheet having the desired lath intervals and the proportion of precipitated Nb can be produced by specifying the cooling and reheating conditions and finish rolling conditions of the cast slab, specifying a cooling rate at the center position of the sheet in the thickness direction in a cooling step after the completion of the finish rolling, and specifying cooling and heat recuperation conditions in a surface layer in the thickness direction.

The present invention has been accomplished on the basis of the foregoing findings. An outline of an embodiment of the present invention will be described below.

[1] An exemplary hot-rolled steel sheet with high toughness, high ductility, and high strength includes a composition that contains, on a mass percent basis:

0.04% or more and 0.15% or less of C, 0.01% or more and 0.55% or less of Si, 1.0% or more and 3.0% or less of Mn, 0.03% or less P, 0.01% or less S, 0.003% or more and 0.1% or less of Al, 0.006% or less N, 0.035% or more and 0.1% or less Nb, 0.001% or more and 0.1% or less of V, 0.001% or more and 0.1% or less Ti, and the balance being Fe and incidental impurities, in which the hot-rolled steel sheet includes a microstructure in which the proportion of precipitated Nb to the total amount of Nb is 35% or more and 80% or less, the volume fraction of tempered martensite and/or tempered bainite having a lath interval of 0.2 μm or more and 1.6 μm or less is 95% or more at a position 1.0 mm from a surface of the sheet in the thickness direction, and the volume fraction of ferrite having a lath interval of 0.2 μm or more and 1.6 μm or less at a center position of the sheet in the thickness direction is 95% or more.

[2] In the hot-rolled steel sheet with high toughness, high ductility, and high strength described in item [1], the composition satisfies the following formulae (1) and (2):

$$Pcm=[\%\ C]+[\%\ Si]/30+([\%\ Mn]+[\%\ Cu]+[\%\ Cr])/20+[\%\ Ni]/60+[\%\ V]/10+[\%\ Mo]/7+5\times[\%\ B]0.25 \quad (1)$$

$$Px=701\times[\%\ C]+85\times[\%\ Mn]\geq 181 \quad (2)$$

where in the formulae (1) and (2), [% C], [% Si], [% Mn], [% Cu], [% Cr], [% Ni], [% V], [% Mo], and [% B] indicate contents of the respective elements (% by mass).

[3] The hot-rolled steel sheet with high toughness, high ductility, and high strength described in item [1] or [2] further contains, on a mass percent basis, 0.0001% or more and 0.005% or less of Ca in addition to the composition.

[4] The hot-rolled steel sheet with high toughness, high ductility, and high strength described in any one of items [1] to [3] further contains, on a mass percent basis, one or more selected from 0.001% or more and 0.5% or less of Cu, 0.001% or more and 0.5% or less of Ni, 0.001% or more and 0.5% or less of Mo, 0.001% or more and 0.5% or less of Cr, and 0.0001% or more and 0.004% or less of B in addition to the composition.

[5] An exemplary method for producing a hot-rolled steel sheet with high toughness, high ductility, and high strength includes:

cooling a continuous cast slab to 600° C. or lower, the continuous cast slab containing, on a mass percent basis, 0.04% or more and 0.15% or less of C, 0.01% or more and 0.55% or less of Si, 1.0% or more and 3.0% or less of Mn, 0.03% or less P, 0.01% or less S, 0.003% or more and 0.1% or less of Al, 0.006% or less N, 0.035% or more and 0.1% or less Nb, 0.001% or more and 0.1% or less of V, 0.001% or more and 0.1% or less Ti, and the balance being Fe and incidental impurities; then performing reheating to a temperature in the range of 1000° C. or higher and 1250° C. or lower; performing rough rolling; after the rough rolling, performing finish rolling at a finishing temperature in the range of ($Ar_3$−50° C.) or higher and ($Ar_3$+100° C.) or lower at a rolling reduction in thickness of 20% or more and 85% or less in a no-recrystallization temperature range; after the completion of the finish rolling, performing cooling such that at a center position of the sheet in the thickness direction, an average cooling rate is 5° C./sec. or more and 50° C./sec. or less in a temperature range of 750° C. or lower and 650° C. or higher and such that at a position 1 mm from a surface of the sheet in the thickness direction, a treatment is performed one or more times and includes a procedure in which after cooling is performed to a cooling stop temperature in the range of 300° C. or higher and 600° C. or lower, heat recuperation is performed to a temperature range of 550° C. or higher and a cooling start temperature or lower over a period of 1 second or more and in which cooling is again performed to a temperature range of 300° C. or higher and 600° C. or lower; and performing coiling in a temperature range of 350° C. or higher and 650° C. or lower.

[6] In the method for producing a hot-rolled steel sheet with high toughness, high ductility, and high strength described in item [5], the composition satisfies the following formulae (1) and (2):

$$Pcm=[\%\ C]+[\%\ Si]/30+([\%\ Mn]+[\%\ Cu]+[\%\ Cr])/20+[\%\ Ni]/60+[\%\ V]/10+[\%\ Mo]/7+5\times[\%\ B]0.25 \quad (1)$$

$$Px=701\times[\%\ C]+85\times[\%\ Mn]181 \quad (2)$$

where in the formulae (1) and (2), [% C], [% Si], [% Mn], [% Cu], [% Cr], [% Ni], [% V], [% Mo], and [% B] indicate contents of the respective elements (% by mass).

[7] The method for producing a hot-rolled steel sheet with high toughness, high ductility, and high strength described in item [5] or [6] further contains, on a mass percent basis, 0.0001% or more and 0.005% or less of Ca in addition to the composition.

[8] The method for producing a hot-rolled steel sheet with high toughness, high ductility, and high strength described in any one of items [5] to [7] further contains, on a mass percent basis, one or more selected from 0.001% or more and 0.5% or less of Cu, 0.001% or more and 0.5% or less of Ni, 0.001% or more and 0.5% or less of Mo, 0.001% or more and 0.5% or less of Cr, and 0.0001% or more and 0.004% or less of B in addition to the composition.

According to the present invention, a thin-to-thick hot-rolled steel sheet which has excellent strength, toughness, and elongation characteristics in terms of the overall thickness and which is suitable as a steel material, e.g., for steel pipes used for pipe lines, oil country tubular goods, civil engineering and construction is provided without the need for a scarce element or the arrangement of additional reheating equipment while high production efficiency is maintained. Thus, the present invention is industrially very useful.

BRIEF DESCRIPTION OF THE DRAWINGS

FIG. 2(*b*) is a photograph (magnification: x20,000) of a microstructure of hot-rolled steel sheet No. 2A (example) in an example with a transmission electron microscope (TEM).

DETAILED DESCRIPTION OF EMBODIMENTS OF THE INVENTION

Figure 1:
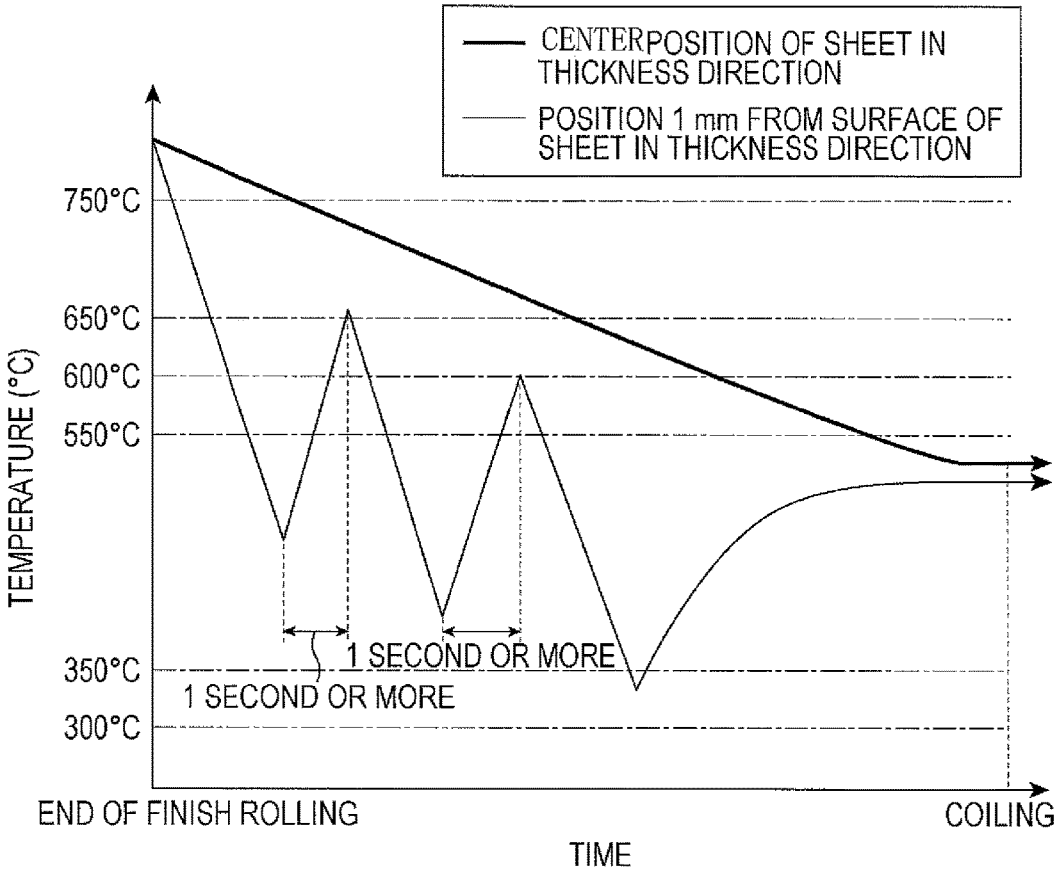
FIG. 1 illustrates temperature history (a center position of a sheet in the thickness direction and a position 1 mm from a surface of the sheet in the thickness direction) in a cooling step after the completion of finish rolling in the present invention.

Non-limiting exemplary embodiment of the present invention will be described in detail below.

The reason for the limitation of the component composition of a hot-rolled steel sheet with high toughness, high ductility, and high strength of the present invention will be described below. Note that % used in the component composition indicates % by mass unless otherwise specified.

C: 0.04% or More and 0.15% or Less

C is an element beneficial for ensuring the strength of the hot-rolled steel sheet by a reduction in the lath intervals of ferrite having a lath structure, tempered martensite, and tempered bainite and the formation of carbides with Nb, V, and Ti. To provide desired strength, the C content is preferably 0.04% or more. A C content more than 0.15% results in an extremely small lath interval of the tempered martensite and/or the tempered bainite serving as the main phase in a surface layer portion of the sheet in the thickness direction and results in an excessive increase of precipitates, thereby reducing the toughness and the elongation characteristics of the hot-rolled steel sheet in terms of the overall thickness. Furthermore, the carbon equivalent is high. When such a hot-rolled steel sheet is formed and welded into a pipe, the toughness of a weld zone is reduced. Thus, the C content may be 0.04% or more and 0.15% or less and preferably in the range of 0.04% to 0.10%.

Si: 0.01% or More and 0.55% or Less

An increase in Si content forms Mn—Si-based nonmetallic inclusions to cause a reduction in the toughness of a weld zone. Thus, the upper limit of the Si content may be 0.55%. The lower limit of the Si content may be 0.01% in light of a deoxidation effect and the limitation of steelmaking technology. The Si content is preferably in the range of 0.10% to 0.45%

Mn: 1.0% or More and 3.0% or Less

Mn is an element beneficial to suppress the formation of polygonal ferrite and ensure the strength and the toughness. To provide the effects, the Mn content is preferably 1.0% or more. A Mn content more than 3.0% is liable to lead to variations in mechanical characteristics due to segregation. Furthermore, excessively high strength may cause an adverse effect, such as a reduction in elongation characteristics. An increase in carbon equivalent may reduce the toughness of a weld zone. Thus, the Mn content may be 1.0% or more and 3.0% or less.

P: 0.03% or Less

S: 0.01% or Less

N: 0.006% or Less

P is present in steep as an impurity and is an element that is easily segregated to reduce the toughness of steel. Thus, the upper limit of the P content may be 0.03% and preferably 0.02% or less.

As with P, S and N also reduce the toughness of steel. Thus, the upper limit of the S content may be 0.01%. The upper limit of the N content may be 0.006%. Preferably, the upper limit of the S content is 0.005% or less.

The practical ability of steelmaking to control P, S, and N is limited. Thus, the lower limit of each of the P and N contents is preferably 0.001%. The lower limit of the S content is preferably 0.0001%.

Al: 0.003% or More and 0.1% or Less

Al is useful as a deoxidizing agent for cupper. The Al content is 0.003% or more at which a deoxidation effect is provided. An excessive Al content results in the formation of alumina-based inclusions, thereby causing defects in a weld zone. Thus, the Al content may be 0.003% or more and 0.1% or less and preferably in the range of 0.003% to 0.06%.

Nb: 0.035% or More and 0.1% or Less

Nb is effective in reducing the size of crystal grains and is a precipitation strengthening element. To ensure X80-grade steel pipe strength, the Nb content is preferably 0.035% or more. An excessive Nb content results in excessive precipitation at the time of the production of the hot-rolled steel sheet in a coiling temperature range (350° C. or higher and 650° C. or lower) described below, thereby reducing the toughness, the elongation characteristics, and the weldability. Thus, the Nb content may be 0.035% or more and 0.1% or less and preferably in the range of 0.035% to 0.08%.

V: 0.001% or More and 0.1% or Less

V is a precipitation strengthening element. To effectively provide the effect, the V content is preferably 0.001% or more. An excessive V content results in excessive precipitation at the time of the production of the hot-rolled steel sheet in the coiling temperature range (350° C. or higher and 650° C. or lower) described below, thereby reducing the toughness, the elongation characteristics, and the weldability. Thus, the V content may be 0.001% or more and 0.1% or less.

Ti: 0.001% or More and 0.1% or Less

Ti is effective in reducing the size of crystal grains and is a precipitation strengthening element. To provide the effects, the Ti content is preferably 0.001% or more. An excessive Ti content results in excessive precipitation at the time of the production of the hot-rolled steel sheet in a coiling temperature range (350° C. or higher and 650° C. or lower) described below, thereby reducing the toughness, the elongation characteristics, and the weldability. Thus, the Ti content may be 0.001% or more and 0.1% or less and preferably in the range of 0.001% to 0.05%.

The high-strength hot-rolled steel sheet with high toughness and high ductility according to the present invention preferably contains 0.0001% or more and 0.005% or less of Ca in addition to the foregoing component composition.

Ca: 0.0001% or More and 0.005% or Less

Ca immobilizes S to inhibit the formation of MnS and thus has the effect of improving the toughness. To provide the effects, the Ca content is preferably 0.0001% or more. An excessive Ca content results in the formation of Ca-based oxide, thereby reducing the toughness. Thus, the Ca content is preferably 0.005% or less and more preferably in the range of 0.001% to 0.0035%.

The high-strength hot-rolled steel sheet with high toughness and high ductility according to the present invention may further contain, in addition to the foregoing component composition, one or more selected from 0.001% or more and 0.5% or less of Cu, 0.001% or more and 0.5% or less of Ni, 0.001% or more and 0.5% or less of Mo, 0.001% or more and 0.5% or less of Cr, and 0.0001% or more and 0.004% or less of B.

Cu: 0.001% or More and 0.5% or Less

Cu is an element effective in controlling the transformation of steel and improving the strength of the hot-rolled steel sheet. To provide the effects, the Cu content is preferably 0.001% or more. Here, Cu has high hardenability. A Cu content more than 0.5% may result in, in particular, an extremely small lath interval of the tempered martensite and/or the tempered bainite serving as the main phase in the surface layer portion of the sheet in the thickness direction, thereby reducing the toughness, the elongation characteristics in terms of the overall thickness, and hot workability. Thus, the Cu content is preferably 0.001% or more and 0.5% or less.

Ni: 0.001% or More and 0.5% or Less

Ni is an element effective in controlling the transformation of steel and improving the strength of the hot-rolled steel sheet. To provide the effects, the Ni content is preferably 0.001% or more. Here, Ni has high hardenability. A Ni content more than 0.5% may result in, in particular, an extremely small lath interval of the tempered martensite and/or the tempered bainite serving as the main phase in the surface layer portion of the sheet in the thickness direction, thereby reducing the toughness, the elongation characteristics in terms of the overall thickness, and hot workability. Thus, the Ni content is preferably 0.001% or more and 0.5% or less.

Mo: 0.001% or More and 0.5% or Less

Mo is an element effective in controlling the transformation of steel and improving the strength of the hot-rolled steel sheet. To provide the effects, the Mo content is preferably 0.001% or more. Here, Mo has high hardenability. A Mo content more than 0.5% may result in, in particular, an extremely small lath interval of the tempered martensite and/or the tempered bainite serving as the main phase in the surface layer portion of the sheet in the thickness direction to reduce the toughness and the elongation characteristics in terms of the overall thickness and may promote the formation of martensite to reduce the toughness. Thus, the Mo content is preferably 0.001% or more and 0.5% or less.

Cr: 0.001% or More and 0.5% or Less

Cr has a delay effect on pearlite transformation and the effect of reducing grain boundary cementite. To provide the effects, the Cr content is preferably 0.001% or more. An excessive Cr content results in, in particular, an extremely small lath interval of the tempered martensite and/or the tempered bainite serving as the main phase in the surface layer portion of the sheet in the thickness direction, thereby reducing the toughness and the elongation characteristics in terms of the overall thickness. Furthermore, at an excessive Cr content, when the hot-rolled steel sheet is formed and welded into a pipe, a hardened microstructure may be formed in a weld zone to reduce the toughness of the weld zone. Thus, the Cr content is preferably 0.001% or more and 0.5% or less.

Cu, Ni, Mo, and Cr are all rare metals, so it is difficult to stably secure these metals. Furthermore, they are expensive elements. Thus, from the viewpoint of, for example, stably securing steel materials and achieving low production cost, the addition of these elements is preferably minimized, and the content of each of the elements is preferably 0.1% or less.

B: 0.0001% or More and 0.004% or Less

B has the effect of inhibiting ferrite transformation at a high temperature and preventing a reduction in the hardness of ferrite in the cooling step after the completion of the finish rolling at the time of the production of the hot-rolled steel sheet. To provide these effects, the B content is preferably 0.0001% or more. An excessive B content may result in the formation of a hardened microstructure in a weld zone. Thus, the B content is preferably 0.0001% or more and 0.004% or less and more preferably in the range of 0.0001% to 0.003%.

The high-strength hot-rolled steel sheet with high toughness and high ductility according to the present invention preferably has a composition that satisfies component indices calculated by the formulae (1) and (2).

$$Pcm=[\%\ C]+[\%\ Si]/30+([\%\ Mn]+[\%\ Cu]+[\%\ Cr])/20+[\%\ Ni]/60+[\%\ V]/10+[\%\ Mo]/7+5\times[\%\ B]0.25 \quad (1)$$

$$Px=701\times[\%\ C]+85\times[\%\ Mn]181 \quad (2)$$

where in the formulae (1) and (2), [% C], [% Si], [% Mn], [% Cu], [% Cr], [% Ni], [% V], [% Mo], and [% B] represent contents of the respective elements (% by mass). In the case where the steel sheet does not contain Cu, [% Cu] in the formula (1) is defined as zero, and the value of Pcm is calculated. The same is true for [% Cr], [% Ni], [% V], [% Mo], and [% B].

Pcm in the formula (1) serves as a hardenability index. A Pcm value more than a certain value has a tendency to lead to, in particular, an extremely small lath interval of the tempered martensite and/or the tempered bainite serving as the main phase in the surface layer portion of the sheet in the thickness direction to reduce the toughness and elongation characteristics of the hot-rolled steel sheet in terms of the overall thickness. Thus, the Pcm value is preferably 0.25 or less and more preferably 0.23 or less. An excessively low Pcm value may cause the softening of a welded heat affected zone (HAZ) at the time of welding for pipe production or the arrangement of line pipes, thereby reducing the tensile properties of joints. Thus, the Pcm value is preferably 0.10 or more.

Px in the formula (2) serves as an index of control of the lath intervals of the ferrite having the lath structure, the tempered martensite, and the tempered bainite in a coiling temperature range (e.g., 350° C. or higher and 650° C. or lower) described below at the time of the production of the hot-rolled steel sheet. To reduce the lath intervals to the extent that X80-grade steel pipe strength is ensured, the Px value is preferably 181 or more. An excessively high Px value may result in an extremely small lath interval of the tempered martensite and/or the tempered bainite serving as the main phase in the surface layer portion of the sheet in the thickness direction, thereby reducing the toughness and the elongation characteristics of the hot-rolled steel sheet in terms of the overall thickness. Thus, the Px value is preferably 300 or less.

In the high-strength hot-rolled steel sheet with high toughness and high ductility according to the present invention, components other than the foregoing components are, e.g., Fe and incidental impurities. Examples of the incidental impurities include Co, W, Pb, and Sn.

Next, the reason for the limitation of the microstructure of the high-strength hot-rolled steel sheet with high toughness and high ductility according to an exemplary embodiment of the present invention will be described.

In the high-strength hot-rolled steel sheet with high toughness and high ductility according to an embodiment of the present invention, the proportion of precipitated Nb to the total amount of Nb is 35% or more and 80% or less. At a position 1.0 mm from a surface of the sheet in the thickness direction, the volume fraction of the tempered martensite and/or the tempered bainite having a lath interval of 0.2 μm or more and 1.6 μm or less is 95% or more. As the balance, for example, ferrite, pearlite, martensite, and retained austenite having a volume fraction of 5% or less may be contained.

At a center position of the sheet in the thickness direction, the steel sheet has a microstructure in which the volume fraction of the ferrite having a lath interval of 0.2 μm or more and 1.6 μm or less is 95% or more. As the balance, for example, tempered martensite, tempered bainite, pearlite, martensite, and retained austenite having a volume fraction of 5% or less may be contained.

Martensite located at the position 1.0 mm from the surface of the sheet in the thickness direction and at the center position of the sheet in the thickness direction does not contain an M-A constituent. Ferrite indicates polygonal ferrite. The ferrite having the lath structure includes acicular ferrite, bainitic ferrite, Widmanstätten-like ferrite, and acicular ferrite.

Proportion of precipitated Nb to total amount of Nb: 35% or more and 80% or less When the proportion of precipitation is less than 35%, the strength is liable to be insufficient, and variations in mechanical properties after the production of pipes are high. When the proportion of precipitation is more than 80%, the hardness of ferrite, tempered martensite, and tempered bainite may be increased, thereby reducing the toughness and the elongation characteristics of the hot-rolled steel sheet. Thus, the upper limit may be 80%.

Method for Measuring Proportion of Precipitated Nb

The proportion (mass ratio) of precipitated Nb in the steel sheet can be determined by measuring the mass of precipitated Nb in the steel sheet by extracted residue analysis and calculating the proportion (% by mass) of the resulting measurement value to the total Nb content. In the extracted residue analysis, the steel sheet is subjected to constant-current electrolysis (about 20 mA/cm$^2$) in 10% acetylacetone-1% tetramethylammonium)-methanol. The resulting undissolved residue is collected with a membrane filter (pore diameter: 0.2 μm) and melted with a flux mixture containing sulfuric acid, nitric acid, and perchloric acid. The amount precipitated is quantified by inductively coupled plasma (ICP) spectrometry.

Main Phase of Hot-Rolled Steel Sheet

In the case of producing a heavy hot-rolled steel sheet having a thickness of, for example, 12 mm or more, after the completion of hot rolling, when the cooling rate is adjusted so as to form the ferrite having a lath structure at the center position of the sheet in the thickness direction, the cooling rate is extremely increased at a surface layer portion of the sheet in the thickness direction. Thus, for such a heavy hot-rolled steel sheet, it is very difficult to allow the microstructure of the main phase to be composed of the ferrite having the lath structure over the entire region in the thickness direction.

In the present invention, the main phase of the surface layer portion of the sheet in the thickness direction (surface layer portion extending from a surface of the steel sheet to a position 1.0 mm from the surface of the sheet in the thickness direction) is composed of the tempered martensite and/or the tempered bainite having a desired lath interval. The main phase of a region other than the surface layer portion is composed of the ferrite having the lath structure with a desired lath interval. Thereby, the high-strength hot-rolled steel sheet with high toughness and excellent elongation characteristics in terms of the overall thickness is provided.

Here, the ferrite having the lath structure is defined as a ferrite transformed at a temperature lower than a temperature at which polygonal ferrite is formed and indicates a ferrite in which the lath structure is observed when a test specimen taken from the center position of the hot-rolled steel sheet in the thickness direction is subjected to TEM observation or SEM observation at a magnification of x5,000 to x20,000. The ferrite having the lath structure includes acicular ferrite, bainitic ferrite, Widmanstätten-like ferrite, and acicular ferrite.

Lath Interval: 0.2 μm or More and 1.6 μm or Less

The lath interval of each of the ferrite having the lath structure, tempered martensite, and tempered bainite are desirably small to some extent because they contribute to the strength of the hot-rolled steel sheet. However, a lath interval less than 0.2 μm results in an excessive increase in the hardness of ferrite, tempered martensite, and tempered bainite even when the precipitation of, for example, Nb, does not occur, thereby reducing the toughness and the elongation characteristics of the hot-rolled steel sheet in terms of the overall thickness. A lath interval more than 1.6 μm may not result in sufficient strength of the hot-rolled steel sheet even when the precipitation of, for example, Nb, occurs sufficiently, thereby failing to satisfy the X80-grade steel pipe strength. Thus, the lath interval is preferably 0.2 μm or more and 1.6 μm or less.

Volume Fraction of Main Phase: 95% or More

In the case where the total volume fraction of the tempered martensite and/or the tempered bainite having a desired lath interval (0.2 μm or more and 1.6 μm or less) is less than 95% at the position 1 mm from the surface of the sheet in the thickness direction (position 1.0 mm from the surface of the steel sheet in the thickness direction), the low-temperature toughness of the surface layer portion of the sheet in the thickness direction is markedly reduced. In the case where the volume fraction of the ferrite having a lath interval (0.2 μm or more and 1.6 μm or less) at the center position of the sheet in the thickness direction is less than 95%, the low-temperature toughness of a region other than the surface layer portion of the sheet in the thickness direction is markedly reduced. Thus, in the present invention, the volume fraction of the main phase in each position is preferably 95% or more.

Next, an exemplary method for producing the high-strength hot-rolled steel sheet with high toughness and high ductility will be described.

The high-strength hot-rolled steel sheet with high toughness and high ductility according to the present invention may be produced by temporarily cooling a slab (cast slab) which is produced, e.g., by continuous casting and which has the foregoing composition or allowing the slab to cool to 600° C. or lower, performing reheating, performing rough rolling and finish rolling, performing accelerated cooling under predetermined conditions, and performing coiling at a predetermined temperature.

Cooling Temperature of Continuous Cast Slab: 600° C. or Lower

In the case where the slab (continuous cast slab) is insufficiently cooled, ferrite transformation is not sufficiently completed in a surface layer region of the slab, so that untransformed austenite is left. When untransformed austenite is left, internal oxidation caused in grain boundaries of austenite during casting is promoted. This may increase surface irregularities of the resulting hot-rolled steel sheet to cause nonuniform deformation under load, thereby reducing the elongation characteristics in terms of the overall thickness. Thus, in one embodiment of the present invention, the cooling temperature of the slab (continuous cast slab) is 600° C. or lower, at which ferrite transformation is sufficiently completed.

Reheating Temperature of Continuous Cast Slab: 1000° C. or Higher and 1250° C. or Lower When the heating temperature of the slab (reheating temperature of the continuous cast slab) is lower than 1000° C., Nb, V, and Ti, which serve as precipitation strengthening elements, may not be sufficiently dissolved to form a solid solution, thereby failing to achieve the X80-grade steel pipe strength. A reheating temperature higher than 1250° C. results in an increase in the size of austenite grains and may result in excessive precipitation of Nb in the cooling and coiling steps after the completion of finish rolling, thereby reducing the toughness and the elongation characteristics of the hot-rolled steel sheet. Thus, the reheating temperature of the continuous cast slab is preferably 1000° C. or higher and 1250° C. or lower.

The reheated slab (continuous cast slab) is subjected to rough rolling and finish rolling to adjust the thickness to a freely-selected thickness. In the present invention, rough rolling conditions are not particularly limited.

Rolling Reduction in Thickness in No-Recrystallization Temperature Range During Finish Rolling: 20% or More and 85% or Less Finish rolling is performed in a no-recrystallization temperature range (about 940° C. or lower for the steel composition according to one embodiment of the present invention), so that the recrystallization of an austenite phase is delayed to accumulate strain, thereby forming finer ferrite to improve the strength and the toughness during $\gamma \rightarrow \alpha$ transformation. Here, when the rolling reduction in thickness in the no-recrystallization temperature range during the finish rolling is less than 20%, these effects may not be sufficiently provided. When the rolling reduction in thickness is more than 85%, deformation resistance is increased to hinder the rolling. Thus, in the present invention, the rolling reduction in thickness may be 20% or more and 85% or less and preferably 35% or more and 75% or less.

Finishing Temperature: ($Ar_3$−50° C.) or Higher and ($Ar_3$+100° C.) or Lower

To complete the rolling in a state in which a uniform grain diameter and a uniform microstructure are provided, the finishing temperature is preferably ($Ar_3$−50° C.) or higher. At a finishing temperature lower than ($Ar_3$−50° C.), ferrite transformation occurs inside the steel sheet during the finish rolling which may lead to a nonuniform microstructure, thereby failing to provide desired characteristics. At a finishing temperature higher than ($Ar_3$+100° C.), the crystal grains are increased in size, thereby reducing the toughness. Thus, the finishing temperature is preferably ($Ar_3$−50° C.) or higher and ($Ar_3$+100° C.) lower.

The finishing temperature is the value of a surface temperature of the steel sheet measured on the delivery side of a finishing mill.

After the completion of the finish rolling, cooling and coiling are performed to provide a hot-rolled steel sheet. In an embodiment of the present invention, the cooling after the completion of the finish rolling is performed in such a manner that the temperature history at the center position of the sheet in the thickness direction is different from that at a surface layer position of the sheet in the thickness direction. FIG. 1 is a schematic diagram of temperature histories after the completion of the finish rolling (temperature histories from the finishing temperature to the coiling temperature) in an embodiment of the present invention. As illustrated in FIG. 1, at the center position of the sheet in the thickness direction, cooling is performed to the coiling temperature at a predetermined cooling rate. At the surface layer position of the sheet in the thickness direction, cooling and heat recuperation treatment is performed one or more times, and then cooling is performed to the coiling temperature.

Average Cooling Rate at Center Position of Sheet in Thickness Direction in Temperature Range of 750° C. or Lower and 650° C. or Higher: 5° C./Sec. or Higher and 50° C./Sec. or Lower.

In order to inhibit pearlite transformation and the formation of polygonal ferrite in the region other than the surface layer portion of the sheet in the thickness direction and in order to ensure the toughness by achieving the volume fraction of 95% or more of ferrite having the lath structure (lath interval: 0.2 μm or more and 1.6 μm or less) at the center position of the sheet in the thickness direction, the average cooling rate is preferably 5° C./sec. or higher at the center position of the sheet in the thickness direction in a preferred temperature range of 750° C. or lower and 650° C. or higher. An excessively high cooling rate at the center position of the sheet in the thickness direction results in an extremely small lath intervals of the ferrite having the lath structure, the tempered martensite, and the tempered bainite, thereby reducing the elongation characteristics. Thus, the upper limit is preferably 50° C./sec.

Position 1 mm from Surface of Sheet: Cooling and Heat Recuperation Treatment

In an embodiment of the present invention, in order to control the total volume fraction of the tempered martensite and/or the tempered bainite having a desired lath interval (0.2 μm or more and 1.6 μm or less) to 95% or more at the position 1.0 mm from the surface of the sheet in the thickness direction, the following treatment may be performed at the position 1 mm from the surface of the sheet in the thickness direction while the cooling rate at the center position of the sheet in the thickness direction is within the range described above. The treatment may be one in which after cooling is performed from an accelerated cooling start temperature to a cooling stop temperature (primary cooling stop temperature) in a temperature range of 300° C. or higher and 600° C. or lower at a freely-selected cooling rate, heat recuperation is performed to a temperature range of 550° C. or higher and the cooling start temperature or lower (primary heat recuperation temperature) over a period of 1 second or more (primary heat recuperation time), and cooling is again performed to a temperature range of 300° C. or higher and 600° C. or lower. It is advantageous to perform the treatment one or more times until coiling. Here, in the case where the treatment is performed n times, the cooling stop temperature is referred to as an "n-th cooling stop temperature", the heat recuperation time is referred to as an "n-th heat recuperation time", and the heat recuperation temperature is referred to as an "n-th heat recuperation temperature". The reason for the regulations of the control factors is described below.

n-th Cooling Stop Temperature: 300° C. or Higher and 600° C. or lower

The treatment aims to temporarily provide a low-temperature transformation microstructure (martensite microstructure and/or bainite microstructure) in the surface layer portion (surface layer region of the sheet in the thickness direction) extending from the surface to the position 1.0 mm from the surface of the sheet in the thickness direction and then to temper the microstructure by heat recuperation. This enables the adjustment of the lath interval of the tempered martensite and/or the tempered bainite in the surface layer portion of the sheet in the thickness direction and enables improvements in surface layer hardness and the elongation characteristics in terms of the overall thickness. At a cooling stop temperature higher than 600° C., the low-temperature transformation microstructure may not be sufficiently formed. Thus, the surface layer portion of the sheet in the thickness direction is not converted into the tempered microstructure, thereby reducing the elongation characteristics in terms of the overall thickness. At an n-th cooling stop temperature lower than 300° C., the temperature does not reach the target heat recuperation temperature. Thus, the tempering may not be sufficiently performed, thereby reducing the elongation characteristics in terms of the overall thickness.

n-th Heat Recuperation Temperature: 550° C. or Higher and Cooling Start Temperature or Lower At a heat recuperation temperature less than 550° C., the microstructure may not be sufficiently tempered to increase the hardness in the surface layer portion of the sheet in the thickness direction, thereby reducing the elongation characteristics in terms of the overall thickness. At a heat recuperation (reheating) temperature higher than the cooling start temperature (usually, the finishing temperature −20° C. to the finishing temperature), reverse transformation from ferrite to austenite occurs in the surface layer portion of the sheet in the thickness direction, so that a tempered microstructure is formed when cooling is again performed, thereby disadvantageously increasing the hardness in the surface layer portion of the sheet in the thickness direction and reducing the elongation characteristics in terms of the overall thickness. Thus, the heat recuperation temperature is preferably in a temperature range of 550° C. or higher and the cooling start temperature or lower.

n-th Heat Recuperation Time: 1 Second or More

At a heat recuperation time less than 1 second, the microstructure is not sufficiently tempered to increase the hardness in the surface layer portion of the sheet in the thickness direction, thereby reducing the elongation characteristics in terms of the overall thickness. Thus, the heat recuperation time is 1 second or more. An excessively long heat recuperation time results in an increase in heat recuperation temperature. As a result, reverse transformation from ferrite to austenite occurs in the surface layer portion of the sheet in the thickness direction, so that a tempered microstructure is formed when cooling is again performed. Thereby, the hardness is increased in the surface layer portion of the sheet in the thickness direction to reduce the elongation characteristics in terms of the overall thickness. This may cause a marked reduction in production efficiency. In this respect, the heat recuperation time is preferably 5 seconds or less.

After the heat recuperation, cooling may be performed to the coiling temperature. Alternatively, after the repetition of predetermined cycles of treatment in which cooling is performed to the temperature range of the cooling stop temperature (300° C. or higher and 600° C. or lower) and then heat recuperation is performed, cooling is performed to the coiling temperature.

As a means for performing the desired cooling and heat recuperation treatment at the position 1 mm from the surface of the sheet in the thickness direction while the cooling rate at the center position of the sheet in the thickness direction is within the range described above, for example, intermittent cooling may be employed. An example of a means other than the intermittent cooling is a means in which induction heating equipment is arranged between cooling banks and the surface layer is heated to the predetermined heat recuperation temperature with the equipment.

Coiling Temperature: 350° C. or Higher and 650° C. or Lower

To use the precipitation strengthening owing to the precipitates of Nb, V, Ti, and so forth, the coiling temperature is preferably 350° C. or higher. To particularly effectively perform the precipitation of the precipitates described above, the coiling temperature is preferably 400° C. or higher. A coiling temperature higher than 650° C. may result in increases in the size of the precipitates and the lath intervals of the ferrite having the lath structure, the tempered martensite, and the tempered bainite, thereby reducing the strength. Furthermore, a coiling temperature higher than 650° C. results in the formation of coarse pearlite to reduce the toughness. Thus, the upper limit is preferably 650° C. The coiling temperature is preferably in the range of 400° C. or higher and 650° C. or lower. Note that the coiling temperature is defined as a temperature of a surface of the steel sheet. However, the temperature is substantially equal to a temperature at the position 1 mm from the surface of the sheet in the thickness direction.

In an embodiment of the present invention, in order to reduce the segregation of the steel components during continuous casting, it is possible to use an electro-magnetic stirrer (EMS), intentional bulging soft reduction casting (IBSR), and so forth. By performing treatment with the electro-magnetic stirrer, an equiaxed crystal is formed in the center portion of the sheet in the thickness direction to reduce the segregation. In the case where the intentional bulging soft reduction casting is performed, the flow of the molten steel of an unsolidified portion of the continuous cast slab is prevented to reduce the segregation of the center portion of the sheet in the thickness direction. By the use of at least one of the treatments for reducing the segregation, absorbed energy ($vE_{-60°}C$), a ductile-brittle fracture surface transition temperature (vTrs), and DWTT characteristics in a Charpy impact test described below are allowed to be superior levels.

EXAMPLES

Slabs (continuous cast slabs, thickness: 215 mm) having compositions listed in Table 1 were subjected to hot rolling under hot-rolling conditions listed in Table 2. After the completion of the hot rolling, cooling was performed under cooling conditions listed in Table 2. Coiling was performed at coiling temperatures listed in Table 2. Thereby, hot-rolled steel sheets (steel strips) having thicknesses listed in Table 2 were produced. In the case of continuous casting, the steel sheets except steel sheet No. 1G listed in Tables 2 to 4 were subjected to treatment for reducing the segregation of the components with an electro-magnetic stirrer (EMS). Intermittent cooling was performed as the cooling after the completion of the hot rolling to adjust the cooling conditions to those listed in Table 2.

Test specimens were taken from the resulting hot-rolled steel sheets and subjected to microstructure observation, extracted residue analysis, a tensile test, an impact test, a DWTT test, and a hardness test by methods described below.

(1) Microstructure Observation

Blockish test specimens such that all positions in the thickness direction can be observed were taken from the resulting hot-rolled steel sheets and subjected to L-section observation (the width direction of each hot-rolled steel sheet was perpendicular to an observation surface) with a scanning electron microscope (magnification: x2000 to x5000). To obtain average microstructure information, at a position of ½ (center) of the thickness of each sheet and a position 1 mm from a surface of each sheet in the thickness direction, observation and photographing were performed in three or more fields of view for each position. Proportions of areas of each of the constituent microstructures (ferrite having a lath structure, tempered martensite, and tempered bainite) to the areas of the fields of observation were determined by image analysis using the resulting microstructure photographs obtained by the observation and photographing in the three or more fields of view. The average values of the proportions were defined as the volume fractions of the constituent microstructures.

Thin-film samples were taken from the center position of each hot-rolled steel sheet in the thickness direction and the position 1 mm from the surface of each sheet. Portions of the thin-film samples where four or more lath boundaries were arranged in parallel were observed and photographed in three or more fields of view for each position with a transmission electron microscope (magnification: x20,000). All lath intervals observed in the resulting photographs were measured. All the lath intervals measured were averaged to determine the lath interval of ferrite at the center position of the sheet in the thickness direction and the lath intervals of tempered martensite and tempered bainite at the position 1 mm from the surface of the sheet in the thickness direction. The case where the lath interval is in the range of 0.2 μm or more and 1.6 μm or less was evaluated to be a "lath interval desirable for strength, toughness, and elongation characteristics".

(2) Extracted Residue Analysis (Method for Measuring Proportion of Precipitated Nb)

Test specimens were taken from the center position of each of the resulting hot-rolled steel sheets in the thickness direction and the position 1 mm from the surface of each sheet. The mass of precipitated Nb in each steel sheet (test specimen) was measured by the extracted reside analysis. In the extracted residue analysis, each steel sheet (test specimen) was subjected to constant-current electrolysis (about 20 mA/cm$^2$) in 10% acetylacetone-1% tetramethylammonium)-methanol. The resulting undissolved residue was collected with a membrane filter (pore diameter: 0.2 μm) and melted with a flux mixture containing sulfuric acid, nitric acid, and perchloric acid. The resulting analyte was diluted with water to a certain volume. The proportion of precipitated Nb was quantified by ICP spectrometry. The case where the proportion of precipitated Nb was in the range of 35% or more and 80% or less at both the center position of the sheet in the thickness direction and the position 1 mm from the surface of the sheet was evaluated to be a "proportion of precipitated Nb desirable for strength, toughness, and elongation characteristics".

(3) Tensile Test

Plate-shape full-thickness tensile specimens (thickness: overall thickness, length of parallel portion: 60 mm, distance between gages: 50 mm, width of gage portion: 38 mm) whose longitudinal direction was a direction (C direction) orthogonal to a rolling direction were taken from the resulting hot-rolled steel sheets. A tensile test was performed at room temperature in conformity with ASTM E8M-04 to determine yield strength YS, tensile strength TS, and total elongation EL. The case where the yield strength was 550 MPa or more, the tensile strength was 650 MPa or more, and the total elongation was 20% or more was evaluated to be "good tensile properties". An excessively high strength results in a reduction in elongation properties. Thus, the yield strength is preferably 690 MPa or less, and the tensile strength is preferably 760 MPa or less.

(4) Charpy Impact Test

V-notched test bars (55 mm long×10 mm high×10 mm wide) whose longitudinal direction was the direction (C direction) orthogonal to the rolling direction were taken from the center position of the resulting hot-rolled steel sheets. A Charpy impact test was performed in conformity with JIS 22242 to determine the absorbed energy (J) at a test temperature of −60° C. and the ductile-brittle fracture surface transition temperature (° C.). Three test bars were used. The arithmetic mean of the absorbed energy values and the arithmetic mean of the ductile-brittle fracture surface transition temperatures were determined and defined as the absorbed energy value ($vE_{-60}$) and the ductile-brittle fracture surface transition temperature (vTrs), respectively, of each steel sheet. The case where $vE_{-60}$ was 100 J or more and vTrs was −80° C. or lower was evaluated to be "good toughness".

(5) DWTT Test

DWTT test specimens (size: overall thickness×3 in. in width×12 in. in length) whose longitudinal direction was the direction (C direction) orthogonal to the rolling direction were taken from the resulting hot-rolled steel sheets. A DWTT test was performed in conformity with ASTM E 436 to determine the lowest temperature (DWTT) at which the shear fracture percentage was 85%. The case where DWTT was −30° C. or lower was evaluated to have "excellent DWTT properties".

(6) Hardness Test

Blockish test specimens (size: overall thickness×10 mm in width×10 mm in length) for hardness measurement were taken from the resulting hot-rolled steel sheets. The hardness at the position 1 mm from the surface of the sheet in the thickness direction was measured with a Vickers hardness tester at a load of 1.0 kg.

The results of items (1) to (6) are listed in Tables 3 and 4.

TABLE 1

| | Chemical component (% by mass) | | | | | | | | | | | | Pcm | Px |
|---|---|---|---|---|---|---|---|---|---|---|---|---|---|---|
| Steel No. | C | Si | Mn | P | S | Al | N | Nb | V | Ti | Ca | Others | *1 | *2 |
| 1 | 0.043 | 0.20 | 1.84 | 0.012 | 0.0015 | 0.0031 | 0.0039 | 0.061 | 0.025 | 0.015 | 0.0019 | — | 0.144 | 187 |
| 2 | 0.072 | 0.21 | 1.75 | 0.014 | 0.0014 | 0.0034 | 0.0033 | 0.059 | 0.030 | 0.020 | 0.0013 | — | 0.170 | 199 |
| 3 | 0.129 | 0.16 | 1.55 | 0.018 | 0.0029 | 0.0030 | 0.0028 | 0.063 | 0.028 | 0.019 | 0.0022 | — | 0.215 | 222 |
| 4 | 0.161 | 0.23 | 1.20 | 0.017 | 0.0018 | 0.0031 | 0.0034 | 0.058 | 0.034 | 0.020 | 0.0020 | — | 0.232 | 215 |
| 5 | 0.030 | 0.17 | 1.89 | 0.018 | 0.0022 | 0.0034 | 0.0032 | 0.044 | 0.032 | 0.015 | 0.0010 | — | 0.133 | 182 |
| 6 | 0.119 | 0.16 | 1.25 | 0.013 | 0.0012 | 0.0045 | 0.0026 | 0.058 | 0.029 | 0.016 | 0.0012 | — | 0.190 | 190 |
| 7 | 0.053 | 0.21 | 2.90 | 0.012 | 0.0018 | 0.0032 | 0.0022 | 0.064 | 0.035 | 0.013 | 0.0024 | — | 0.209 | 284 |
| 8 | 0.111 | 0.20 | 0.90 | 0.015 | 0.0018 | 0.0043 | 0.0023 | 0.055 | 0.033 | 0.014 | 0.0019 | — | 0.166 | 154 |
| 9 | 0.049 | 0.21 | 3.30 | 0.013 | 0.0012 | 0.0035 | 0.0034 | 0.057 | 0.028 | 0.020 | 0.0020 | — | 0.214 | 308 |
| 10 | 0.071 | 0.22 | 1.73 | 0.013 | 0.0027 | 0.0036 | 0.0025 | 0.063 | 0.034 | 0.018 | 0.0014 | Cu: 0.09, Ni: 0.09 | 0.174 | 197 |
| 11 | 0.070 | 0.18 | 1.72 | 0.015 | 0.0025 | 0.0043 | 0.0030 | 0.056 | 0.031 | 0.017 | 0.0014 | Cu: 0.29, Ni: 0.30 | 0.185 | 195 |
| 12 | 0.070 | 0.16 | 1.74 | 0.018 | 0.0027 | 0.0045 | 0.0029 | 0.058 | 0.034 | 0.016 | 0.0016 | Mo: 0.09 | 0.179 | 197 |
| 13 | 0.072 | 0.16 | 1.76 | 0.015 | 0.0025 | 0.0032 | 0.0035 | 0.056 | 0.030 | 0.017 | 0.0017 | Mo: 0.26 | 0.205 | 200 |
| 14 | 0.075 | 0.19 | 1.73 | 0.018 | 0.0015 | 0.0033 | 0.0029 | 0.060 | 0.036 | 0.017 | 0.0013 | Cr: 0.09 | 0.176 | 200 |
| 15 | 0.073 | 0.25 | 1.75 | 0.012 | 0.0027 | 0.0036 | 0.0033 | 0.058 | 0.036 | 0.013 | 0.0019 | Cr: 0.23 | 0.184 | 200 |
| 16 | 0.040 | 0.21 | 1.85 | 0.017 | 0.0023 | 0.0044 | 0.0025 | 0.058 | 0.032 | 0.019 | 0.0023 | B: 0.0005 | 0.145 | 185 |
| 17 | 0.044 | 0.20 | 1.86 | 0.012 | 0.0015 | 0.0038 | 0.0035 | 0.057 | 0.026 | 0.018 | 0.0030 | B: 0.0016 | 0.154 | 189 |
| 18 | 0.041 | 0.20 | 1.35 | 0.012 | 0.0021 | 0.0038 | 0.0029 | 0.063 | 0.036 | 0.013 | 0.0029 | — | 0.119 | 143 |
| 19 | 0.041 | 0.18 | 1.82 | 0.013 | 0.0012 | 0.0031 | 0.0026 | 0.047 | 0.026 | 0.018 | 0.0021 | — | 0.141 | 183 |
| 20 | 0.135 | 0.20 | 1.41 | 0.017 | 0.0023 | 0.0039 | 0.0022 | 0.062 | 0.035 | 0.020 | 0.0014 | — | 0.216 | 214 |
| 21 | 0.041 | 0.24 | 1.80 | 0.012 | 0.0015 | 0.0038 | 0.0033 | 0.060 | 0.029 | 0.015 | 0.0019 | — | 0.142 | 182 |
| 22 | 0.132 | 0.21 | 1.20 | 0.012 | 0.0017 | 0.0034 | 0.0030 | 0.061 | 0.036 | 0.014 | 0.0019 | — | 0.203 | 195 |
| 23 | 0.048 | 0.24 | 1.75 | 0.015 | 0.0029 | 0.0036 | 0.0027 | 0.044 | 0.028 | 0.014 | 0.0024 | — | 0.146 | 182 |
| 24 | 0.051 | 0.20 | 1.77 | 0.016 | 0.0017 | 0.0039 | 0.0030 | 0.057 | 0.025 | 0.015 | 0.0012 | — | 0.149 | 186 |
| 25 | 0.148 | 0.16 | 1.75 | 0.013 | 0.0024 | 0.0034 | 0.0027 | 0.059 | 0.036 | 0.016 | 0.0019 | — | 0.244 | 252 |
| 26 | 0.040 | 0.24 | 1.85 | 0.015 | 0.0020 | 0.0033 | 0.0029 | 0.061 | 0.024 | 0.013 | 0.0015 | — | 0.143 | 185 |
| 27 | 0.090 | 0.20 | 1.85 | 0.017 | 0.0019 | 0.0037 | 0.0031 | 0.065 | 0.033 | 0.015 | 0.0014 | — | 0.192 | 220 |
| 28 | 0.061 | 0.18 | 1.88 | 0.011 | 0.0014 | 0.0040 | 0.0022 | 0.055 | 0.059 | 0.012 | — | — | 0.167 | 203 |

*1 Pcm = [% C] + [% Si]/30 + ([% Mn] + [% Cu] + [% Cr])/20 + [% Ni]/60 + [% V]/10 + [% Mo]/7 + 5 × [% B]

*2 Px = 701 × [% C] + 85 × [% Mn]

[% C], [% Si], [% Mn], [% Cu], [% Cr], [% Ni], [% V], [% Mo], and [% B] indicate contents of the respective elements (% by mass)

TABLE 2

| Steel sheet No. | Steel No. | $Ar_3$ point (° C.) | Cooling temperature of slab (° C.) | Reheating temperature of slab (° C.) | Finish rolling condition: Finishing temperature (° C.) | Finish rolling condition: No-recrystallization rolling reduction (%) | Treatment conditions after completion of finish rolling: Average cooling rate at center position of sheet in thickness direction (° C./sec.) *3 |
|---|---|---|---|---|---|---|---|
| 1A | 1 | 731 | 303 | 1220 | 740 | 54 | 30 |
| 1B | | 731 | 367 | 1220 | 730 | 63 | 8 |
| 1C | | 731 | 297 | 1210 | 750 | 58 | 3 |
| 1D | | 731 | 291 | 1210 | 750 | 58 | 3 |
| 1E | | 731 | 281 | 1220 | 740 | 56 | 45 |
| 1F | | 731 | 424 | 1220 | 770 | 53 | 60 |
| 1G | | 731 | 285 | 1220 | 740 | 56 | 45 |
| 2A | 2 | 726 | 282 | 1190 | 750 | 54 | 28 |
| 2B | | 726 | 428 | 1220 | 760 | 30 | 28 |
| 3A | 3 | 716 | 380 | 1210 | 730 | 53 | 38 |
| 4A | 4 | 728 | 194 | 1190 | 750 | 63 | 22 |
| 5A | 5 | 732 | 177 | 1210 | 740 | 52 | 32 |
| 6A | 6 | 740 | 427 | 1220 | 780 | 56 | 39 |
| 7A | 7 | 655 | 263 | 1220 | 700 | 60 | 28 |
| 8A | 8 | 768 | 416 | 1190 | 820 | 54 | 25 |
| 9A | 9 | 633 | 227 | 1200 | 670 | 63 | 21 |
| 10A | 10 | 728 | 160 | 1200 | 740 | 59 | 39 |
| 11A | 11 | 728 | 363 | 1190 | 760 | 62 | 21 |
| 12A | 12 | 726 | 315 | 1190 | 740 | 56 | 24 |
| 13A | 13 | 724 | 381 | 1220 | 730 | 53 | 26 |
| 14A | 14 | 725 | 424 | 1190 | 740 | 63 | 29 |
| 15A | 15 | 726 | 406 | 1190 | 770 | 62 | 39 |
| 16A | 16 | 732 | 242 | 1210 | 780 | 61 | 30 |
| 17A | 17 | 729 | 319 | 1200 | 760 | 51 | 38 |
| 18A | 18 | 765 | 251 | 1190 | 780 | 55 | 20 |
| 19A | 19 | 733 | 181 | 1190 | 750 | 50 | 40 |
| 20A | 20 | 724 | 424 | 1190 | 730 | 50 | 34 |
| 21A | 21 | 735 | 250 | 1190 | 740 | 63 | 38 |
| 22A | 22 | 739 | 425 | 1210 | 750 | 58 | 33 |
| 23A | 23 | 736 | 209 | 1220 | 780 | 59 | 40 |
| 24A | 24 | 732 | 391 | 1200 | 780 | 53 | 21 |
| 25A | 25 | 693 | 262 | 1220 | 710 | 60 | 33 |
| 26A | 26 | 732 | 183 | 1220 | 750 | 56 | 28 |
| 26B | | 732 | 189 | 1220 | 780 | 54 | 22 |
| 26C | | 732 | 442 | 1200 | 760 | 57 | 24 |
| 26D | | 732 | 310 | 1200 | 730 | 54 | 23 |
| 26E | | 732 | 337 | 1220 | 770 | 63 | 40 |
| 27A | 27 | 712 | 183 | 1190 | 720 | 57 | 20 |
| 27B | | 712 | 237 | 1220 | 740 | 61 | 37 |
| 27C | | 712 | 211 | 980 | 710 | 51 | 39 |
| 27D | | 712 | 333 | 1300 | 730 | 54 | 40 |
| 28A | 28 | 721 | 461 | 1210 | 752 | 49 | 26 |

| Steel sheet No. | Treatment conditions after completion of finish rolling, Position 1 mm from surface of sheet in thickness direction: Primary cooling stop temperature (° C.) | Primary heat recuperation time (sec.) | Primary heat recuperation temperature (° C.) | Secondary cooling stop temperature (° C.) | Secondary heat recuperation time (sec.) | Secondary heat recuperation temperature (° C.) | Coiling temperature (° C.) |
|---|---|---|---|---|---|---|---|
| 1A | 390 | 2.4 | 610 | — | — | — | 470 |
| 1B | 360 | 3.3 | 590 | — | — | — | 480 |
| 1C | 380 | 3.4 | 610 | — | — | — | 460 |
| 1D | 370 | 3.0 | 600 | — | — | — | 660 |
| 1E | 360 | 1.7 | 580 | — | — | — | 460 |
| 1F | 360 | 1.3 | 570 | — | — | — | 490 |
| 1G | 360 | 1.8 | 580 | — | — | — | 460 |
| 2A | 350 | 3.0 | 580 | — | — | — | 470 |
| 2B | 400 | 1.4 | 610 | — | — | — | 440 |
| 3A | 420 | 3.4 | 650 | — | — | — | 460 |
| 4A | 440 | 2.5 | 670 | — | — | — | 460 |
| 5A | 440 | 3.0 | 670 | — | — | — | 470 |
| 6A | 420 | 3.1 | 650 | — | — | — | 450 |
| 7A | 370 | 1.5 | 590 | — | — | — | 440 |
| 8A | 370 | 1.9 | 590 | — | — | — | 480 |
| 9A | 410 | 1.8 | 630 | — | — | — | 490 |
| 10A | 370 | 3.5 | 610 | — | — | — | 440 |
| 11A | 380 | 2.5 | 610 | — | — | — | 460 |
| 12A | 410 | 3.2 | 640 | — | — | — | 630 |
| 13A | 390 | 2.0 | 610 | — | — | — | 410 |
| 14A | 410 | 3.1 | 640 | — | — | — | 600 |

TABLE 2-continued

| | | | | | | | |
|---|---|---|---|---|---|---|---|
| 15A | 370 | 3.0 | 600 | — | — | — | 430 |
| 16A | 440 | 1.5 | 660 | — | — | — | 400 |
| 17A | 440 | 1.3 | 650 | — | — | — | 470 |
| 18A | 370 | 2.8 | 600 | — | — | — | 340 |
| 19A | 380 | 1.3 | 590 | — | — | — | 470 |
| 20A | 410 | 1.4 | 620 | — | — | — | 480 |
| 21A | 440 | 3.1 | 670 | — | — | — | 490 |
| 22A | 400 | 2.2 | 620 | — | — | — | 460 |
| 23A | 360 | 1.5 | 580 | — | — | — | 460 |
| 24A | 380 | 1.7 | 600 | — | — | — | 450 |
| 25A | 380 | 2.1 | 600 | — | — | — | 470 |
| 26A | 270 | 1.9 | 490 | — | — | — | 460 |
| 26B | 650 | 1.4 | 770 | — | — | — | 450 |
| 26C | 400 | 0.8 | 530 | — | — | — | 460 |
| 26D | 590 | 1.2 | 700 | 360 | 1.2 | 560 | 400 |
| 26E | 450 | 2.6 | 680 | — | — | — | 670 |
| 27A | 360 | 3.1 | 590 | — | — | — | 380 |
| 27B | 360 | 3.2 | 590 | — | — | — | 330 |
| 27C | 360 | 2.0 | 580 | — | — | — | 510 |
| 27D | 420 | 1.7 | 640 | — | — | — | 520 |
| 28A | 380 | 2.5 | 600 | — | — | — | 510 |

*3 Average cooling rate in a temperature range of 750° C. or lower and 650° C. or higher

TABLE 3

| | | Microstructure of hot-rolled steel sheet *5 | | | | | | |
|---|---|---|---|---|---|---|---|---|
| | | Center position of sheet in thickness direction | | | Position 1 mm from surface of sheet in thickness direction | | | |
| Steel sheet No. | Steel No. | Proportion of precipitated Nb (%)*4 | F lath interval (□m) | F volume fraction (%) | Proportion of precipitated Nb (%)*4 | TM, TB lath interval (□m) | TM, TB volume fraction (%)*6 | Remarks |
| 1A | 1 | 39 | 1.15 | 98 | 38 | 0.91 | 99 | Example |
| 1B | | 40 | 1.21 | 98 | 39 | 0.82 | 97 | Example |
| 1C | | 42 | 1.18 | 92 | 40 | 0.86 | 95 | Comparative example |
| 1D | | 75 | — | — | 74 | 1.43 | 97 | Comparative example |
| 1E | | 41 | 1.11 | 96 | 39 | 0.78 | 98 | Example |
| 1F | | 40 | 0.16 | 99 | 38 | 0.12 | 98 | Comparative example |
| 1G | | 40 | 1.15 | 95 | 40 | 0.80 | 98 | Example |
| 2A | 2 | 49 | 0.95 | 97 | 48 | 0.62 | 99 | Example |
| 2B | | 48 | 0.94 | 98 | 47 | 0.69 | 99 | Example |
| 3A | 3 | 70 | 0.46 | 96 | 68 | 0.25 | 98 | Example |
| 4A | 4 | 84 | 0.22 | 99 | 82 | 0.16 | 97 | Comparative example |
| 5A | 5 | 32 | 1.23 | 97 | 29 | 0.98 | 97 | Comparative example |
| 6A | 6 | 67 | 0.53 | 97 | 66 | 0.32 | 97 | Example |
| 7A | 7 | 52 | 1.32 | 98 | 49 | 0.99 | 98 | Example |
| 8A | 8 | 63 | 1.77 | 83 | 60 | 0.30 | 98 | Comparative example |
| 9A | 9 | 40 | 1.16 | 98 | 37 | 0.80 | 97 | Comparative example |
| 10A | 10 | 48 | 0.92 | 98 | 46 | 0.77 | 98 | Example |
| 11A | 11 | 49 | 0.91 | 97 | 47 | 0.66 | 98 | Example |
| 12A | 12 | 51 | 1.00 | 97 | 50 | 0.80 | 97 | Example |
| 13A | 13 | 52 | 0.91 | 96 | 50 | 0.60 | 97 | Example |
| 14A | 14 | 50 | 0.95 | 98 | 48 | 0.55 | 97 | Example |
| 15A | 15 | 47 | 0.93 | 98 | 46 | 0.75 | 99 | Example |
| 16A | 16 | 40 | 1.13 | 99 | 39 | 0.94 | 97 | Example |
| 17A | 17 | 41 | 1.16 | 96 | 40 | 0.95 | 98 | Example |
| 18A | 18 | 40 | 1.69 | 96 | 37 | 0.86 | 97 | Comparative example |
| 19A | 19 | 61 | 1.55 | 97 | 58 | 1.46 | 99 | Example |
| 20A | 20 | 62 | 0.26 | 98 | 59 | 0.22 | 98 | Example |
| 21A | 21 | 56 | 1.56 | 96 | 55 | 1.31 | 97 | Example |
| 22A | 22 | 66 | 0.29 | 98 | 63 | 0.22 | 99 | Example |
| 23A | 23 | 39 | 0.86 | 98 | 36 | 0.46 | 99 | Example |
| 24A | 24 | 41 | 1.07 | 96 | 39 | 0.74 | 98 | Example |
| 25A | 25 | 77 | 0.64 | 96 | 79 | 0.41 | 97 | Example |
| 26A | 26 | 40 | 1.14 | 99 | 35 | 0.14 | 5 (*7) | Comparative example |
| 26B | | 41 | 1.17 | 99 | 40 | 0.18 | 2 (*7) | Comparative example |
| 26C | | 39 | 1.16 | 99 | 38 | 0.15 | 98 | Comparative example |
| 26D | | 42 | 0.93 | 97 | 41 | 0.71 | 99 | Example |
| 26E | | 69 | 1.77 | 96 | 66 | 1.52 | 98 | Comparative example |
| 27A | 27 | 43 | 0.49 | 97 | 40 | 0.34 | 98 | Example |

TABLE 3-continued

| Steel sheet No. | Steel No. | Microstructure of hot-rolled steel sheet *5 | | | | | | Remarks |
|---|---|---|---|---|---|---|---|---|
| | | Center position of sheet in thickness direction | | | Position 1 mm from surface of sheet in thickness direction | | | |
| | | Proportion of precipitated Nb (%)*4 | F lath interval (□m) | F volume fraction (%) | Proportion of precipitated Nb (%)*4 | TM, TB lath interval (□m) | TM, TB volume fraction (%)*6 | |
| 27B | | 34 | 0.33 | 96 | 33 | 0.24 | 99 | Comparative example |
| 27C | | 23 | 0.86 | 97 | 22 | 0.61 | 98 | Comparative example |
| 27D | | 84 | 0.90 | 96 | 82 | 0.64 | 97 | Comparative example |
| 28A | 28 | 55 | 1.20 | 98 | 52 | 1.03 | 98 | Example |

*4Proportion of precipitated Nb to the total amount of Nb in each hot-rolled steel sheet.

*5 F: ferrite having a lath structure, TM: tempered martensite, TB tempered bainite

*6The total of the volume fraction of tempered martensite (TM) and the volume fraction of tempered bainite (TB).

(*7) Most of the microstructure is a martensite and/or bainite microstructure because of insufficient hardening or tempering.

TABLE 4

| Steel sheet No. | Steel No. | Mechanical properties of hot-rolled steel sheet | | | | | | | Remarks |
|---|---|---|---|---|---|---|---|---|---|
| | | Yield stress YS(MPa) | Tensile strength TS(MPa) | Total elongation EL(%) | Hardness at position 1 mm from surface of sheet in thickness direction Hv | vTrs (° C.) *8 | vE−60 (J) *9 | DWTT SA85% (° C.) *10 | |
| 1A | 1 | 591 | 658 | 33 | 234 | −130 | 312 | −60 | Example |
| 1B | | 594 | 655 | 34 | 201 | −130 | 309 | −60 | Example |
| 1C | | 596 | 660 | 36 | 237 | −100 | 295 | −25 | Comparative example |
| 1D | | 598 | 671 | 30 | 259 | −75 | 150 | −5 | Comparative example |
| 1E | | 595 | 657 | 32 | 270 | −130 | 323 | −60 | Example |
| 1F | | 594 | 656 | 18 | 315 | −130 | 301 | −60 | Comparative example |
| 1G | | 597 | 659 | 31 | 272 | −90 | 295 | −35 | Example |
| 2A | 2 | 602 | 670 | 29 | 236 | −120 | 246 | −50 | Example |
| 2B | | 606 | 671 | 27 | 261 | −110 | 274 | −40 | Example |
| 3A | 3 | 610 | 692 | 23 | 257 | −100 | 114 | −35 | Example |
| 4A | 4 | 594 | 683 | 16 | 309 | −95 | 48 | −20 | Comparative example |
| 5A | 5 | 580 | 642 | 35 | 207 | −135 | 334 | −60 | Comparative example |
| 6A | 6 | 579 | 659 | 24 | 250 | −105 | 136 | −35 | Example |
| 7A | 7 | 685 | 751 | 23 | 255 | −120 | 290 | −50 | Example |
| 8A | 8 | 544 | 622 | 29 | 199 | −110 | 158 | −35 | Comparative example |
| 9A | 9 | 715 | 778 | 16 | 277 | −130 | 312 | −60 | Comparative example |
| 10A | 10 | 609 | 679 | 29 | 256 | −120 | 255 | −50 | Example |
| 11A | 11 | 629 | 699 | 28 | 205 | −120 | 267 | −50 | Example |
| 12A | 12 | 610 | 680 | 27 | 274 | −125 | 258 | −50 | Example |
| 13A | 13 | 624 | 694 | 26 | 254 | −120 | 229 | −50 | Example |
| 14A | 14 | 604 | 674 | 25 | 234 | −120 | 261 | −50 | Example |
| 15A | 15 | 611 | 681 | 26 | 250 | −120 | 250 | −50 | Example |
| 16A | 16 | 621 | 684 | 32 | 254 | −130 | 300 | −60 | Example |
| 17A | 17 | 661 | 724 | 29 | 237 | −130 | 312 | −60 | Example |
| 18A | 18 | 548 | 612 | 39 | 219 | −130 | 318 | −60 | Comparative example |
| 19A | 19 | 579 | 655 | 34 | 217 | −115 | 315 | −40 | Example |
| 20A | 20 | 599 | 683 | 22 | 237 | −110 | 103 | −35 | Example |
| 21A | 21 | 588 | 655 | 34 | 216 | −115 | 312 | −45 | Example |
| 22A | 22 | 582 | 665 | 24 | 205 | −110 | 105 | −35 | Example |
| 23A | 23 | 581 | 658 | 32 | 252 | −135 | 296 | −60 | Example |
| 24A | 24 | 589 | 658 | 33 | 241 | −125 | 290 | −55 | Example |
| 25A | 25 | 638 | 725 | 23 | 261 | −100 | 113 | −35 | Example |
| 26A | 26 | 591 | 659 | 17 | 311 | −130 | 312 | −60 | Comparative example |
| 26B | | 597 | 660 | 15 | 320 | −130 | 318 | −60 | Comparative example |
| 26C | | 589 | 659 | 17 | 309 | −130 | 308 | −60 | Comparative example |
| 26D | | 586 | 664 | 34 | 251 | −135 | 295 | −65 | Example |
| 26E | | 491 | 554 | 33 | 184 | −90 | 294 | −15 | Comparative example |
| 27A | 27 | 585 | 659 | 24 | 209 | −125 | 195 | −50 | Example |
| 27B | | 570 | 646 | 27 | 203 | −130 | 200 | −60 | Comparative example |
| 27C | | 575 | 639 | 26 | 203 | −110 | 205 | −40 | Comparative example |
| 27D | | 631 | 694 | 16 | 227 | −85 | 220 | −10 | Comparative example |
| 28A | 28 | 616 | 687 | 29 | 276 | −120 | 266 | −70 | Example |

*8 Ductile-brittle fracture surface transition temperature.

*9 Absorbed energy at −60° C.

As listed in Tables 3 and 4, in the hot-rolled steel sheets of examples, no excessively hardened surface layer portion was observed, and the tensile properties (strength and ductility) and the toughness (low-temperature toughness) were all good. In contrast, in the hot-rolled steel sheets of comparative examples, sufficient properties were not provided in terms of either or both of the tensile properties and toughness (low-temperature toughness).

Figure 2:
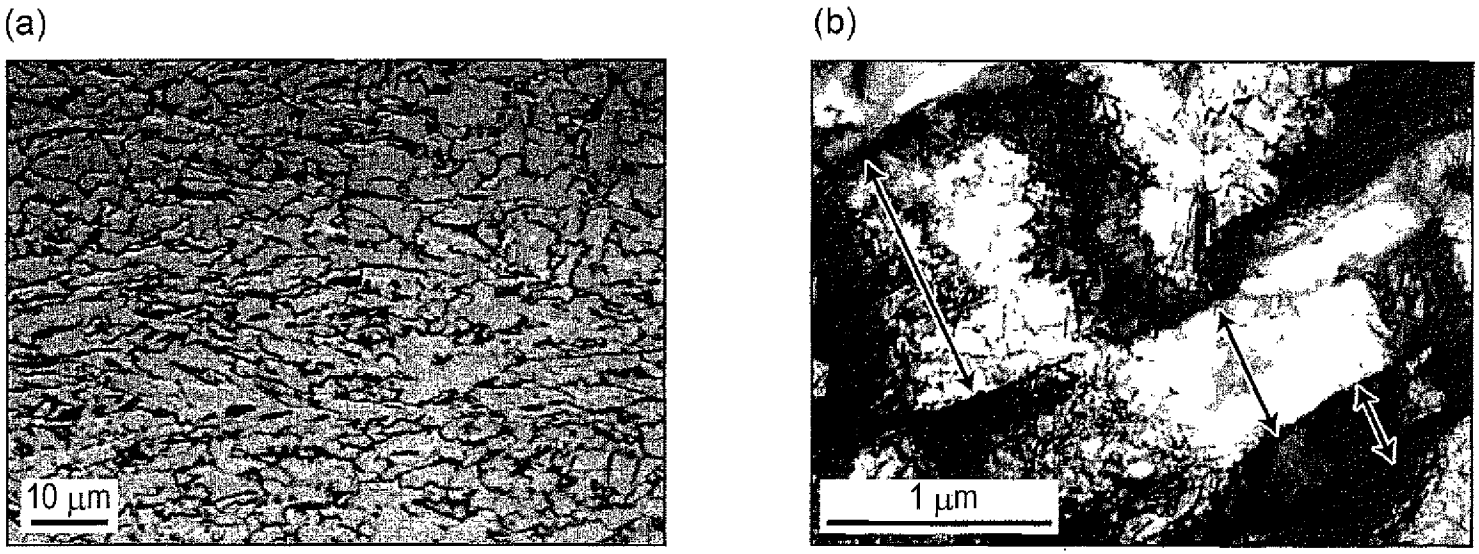
FIG. 2(*a*) is a photograph (magnification: x1000) of a microstructure of hot-rolled steel sheet No. 2A (example) in an example with an optical microscope.

FIGS. 2(*a*) and 2(*b*) are observation results of a test specimen taken from the center position of the hot-rolled steel sheet (steel sheet: 2A) in the thickness direction according to an example listed in Tables 2 to 4. FIG. 2(*a*) is a photograph of a microstructure by optical microscope observation (magnification: x1000). FIG. 2(*b*) is a photograph of the microstructure by TEM observation (magnification: x20,000). In FIG. 2(*a*), the lath structure of each of ferrite, tempered martensite, and tempered bainite is not observed. However, in FIG. 2(*b*), the lath structure of each of ferrite, tempered martensite, and tempered bainite can be identified (this photograph illustrates ferrite). Arrows in FIG. 2(*b*) indicate the lath intervals.

The invention claimed is:

1. A hot-rolled steel sheet comprising a composition that contains, on a mass percent basis:

0.04% or more and 0.15% or less of C, 0.01% or more and 0.55% or less of Si, 1.0% or more and 3.0% or less of Mn, 0.03% or less P, 0.01% or less S, 0.003% or more and 0.1% or less of Al, 0.006% or less N, 0.035% or more and 0.1% or less Nb, 0.001% or more and 0.1% or less of V, 0.001% or more and 0.1% or less Ti, and the balance being Fe and incidental impurities, wherein the hot-rolled steel sheet has a thickness of 12 mm or more and comprises a microstructure in which the proportion of precipitated Nb to the total amount of Nb is 35% or more and 80% or less, the volume fraction of tempered martensite and/or tempered bainite having a lath interval of 0.2 μm or more and 1.6 μm or less is 95% or more at a position 1.0 mm from a surface of the sheet in the thickness direction, and the volume fraction of ferrite having a lath interval of 0.2 μm or more and 1.6 μm or less at the center position of the sheet in the thickness direction is 95% or more.

2. The hot-rolled steel sheet according to claim 1, wherein the composition satisfies the following formulae (1) and (2):

$$Pcm=[\%\ C]+[\%\ Si]/30+([\%\ Mn]+[\%\ Cu]+[\%\ Cr])/20+[\%\ Ni]/60+[\%\ V]/10+[\%\ Mo]/7+5\times[\%\ B]\leq 0.25 \quad (1)$$

$$Px=701\times[\%\ C]+85\times[\%\ Mn]\geq 181 \quad (2)$$

where in the formulae (1) and (2), [% C], [% Si], [% Mn], [% Cu], [% Cr], [% Ni], [% V], [% Mo], and [% B] indicate contents of the respective elements (% by mass).

3. The hot-rolled steel sheet according to claim 1, further comprising, on a mass percent basis, 0.0001% or more and 0.005% or less of Ca in addition to the composition.

4. The hot-rolled steel sheet according to claim 1, further comprising, on a mass percent basis, one or more selected from 0.001% or more and 0.5% or less of Cu, 0.001% or more and 0.5% or less of Ni, 0.001% or more and 0.5% or less of Mo, 0.001% or more and 0.5% or less of Cr, and 0.0001% or more and 0.004% or less of B in addition to the composition.

5. The hot-rolled steel sheet according to claim 2, further comprising, on a mass percent basis, 0.0001% or more and 0.005% or less of Ca in addition to the composition.

6. The hot-rolled steel sheet according to claim 2, further comprising, on a mass percent basis, one or more selected from 0.001% or more and 0.5% or less of Cu, 0.001% or more and 0.5% or less of Ni, 0.001% or more and 0.5% or less of Mo, 0.001% or more and 0.5% or less of Cr, and 0.0001% or more and 0.004% or less of B in addition to the composition.

7. The hot-rolled steel sheet according to claim 3, further comprising, on a mass percent basis, one or more selected from 0.001% or more and 0.5% or less of Cu, 0.001% or more and 0.5% or less of Ni, 0.001% or more and 0.5% or less of Mo, 0.001% or more and 0.5% or less of Cr, and 0.0001% or more and 0.004% or less of B in addition to the composition.

8. The hot-rolled steel sheet according to claim 5, further comprising, on a mass percent basis, one or more selected from 0.001% or more and 0.5% or less of Cu, 0.001% or more and 0.5% or less of Ni, 0.001% or more and 0.5% or less of Mo, 0.001% or more and 0.5% or less of Cr, and 0.0001% or more and 0.004% or less of B in addition to the composition.

* * * * *